US010479650B2

(12) United States Patent
Alasentie et al.

(10) Patent No.: US 10,479,650 B2
(45) Date of Patent: Nov. 19, 2019

(54) ARRANGEMENT FOR REDUCING DISPLACEMENT OF AN ELEVATOR CAR CAUSED BY A CHANGE IN LOADING

(71) Applicant: KONE Corporation, Helsinki (FI)

(72) Inventors: Pentti Alasentie, Espoo (FI); Hannu Lehtinen, Numminen (FI); Pekka Rantanen, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 850 days.

(21) Appl. No.: 14/965,672

(22) Filed: Dec. 10, 2015

(65) Prior Publication Data

US 2016/0096708 A1 Apr. 7, 2016

Related U.S. Application Data

(63) Continuation of application No. PCT/FI2014/050550, filed on Jul. 3, 2014.

(30) Foreign Application Priority Data

Jul. 4, 2013 (FI) ..... 20135737

(51) Int. Cl.

| | |
|---|---|
| ***B66B 7/10*** | (2006.01) |
| ***B66B 17/34*** | (2006.01) |
| ***B66B 11/04*** | (2006.01) |

(52) U.S. Cl.

CPC ..... *B66B 7/10* (2013.01); *B66B 11/04* (2013.01); *B66B 17/34* (2013.01)

(58) Field of Classification Search

CPC combination set(s) only.
See application file for complete search history.

(56) References Cited

U.S. PATENT DOCUMENTS

| | | | | |
|---|---|---|---|---|
| 2011/0017552 | A1* | 1/2011 | Lindberg et al. | B66B 11/04 |
| 2014/0130420 | A1* | 5/2014 | Talonen | B66B 11/04 |

FOREIGN PATENT DOCUMENTS

| | | | |
|---|---|---|---|
| CN | 102627205 | A | 8/2012 |
| GB | 2 163 127 | A | 2/1986 |
| WO | WO 2011/039405 | A1 | 4/2011 |
| WO | WO 2012/175807 | A1 | 12/2012 |

* cited by examiner

*Primary Examiner* — Diem M Tran
(74) *Attorney, Agent, or Firm* — Birch, Stewart, Kolasch & Birch, LLP

(57) ABSTRACT

An arrangement for reducing the displacement of an elevator car caused by a change in loading includes at least an elevator car configured to move up and down in an elevator hoistway and one or more counterweights, and also at least one rope element above the elevator car and at least one rope element below the elevator car and at least one pretensioner of the rope elements. The elevator car and counterweight are configured to be supported and moved via the rope elements and the pretensioner and rope pulleys, of which rope pulleys the first part are diverting pulleys, and the second part are traction sheaves. The arrangement additionally includes at least two hoisting machines. In the arrangement is a mechanism configured to lock at least two rope pulleys to be non-rotating at least during loading of the elevator car.

20 Claims, 4 Drawing Sheets

Figure 1:
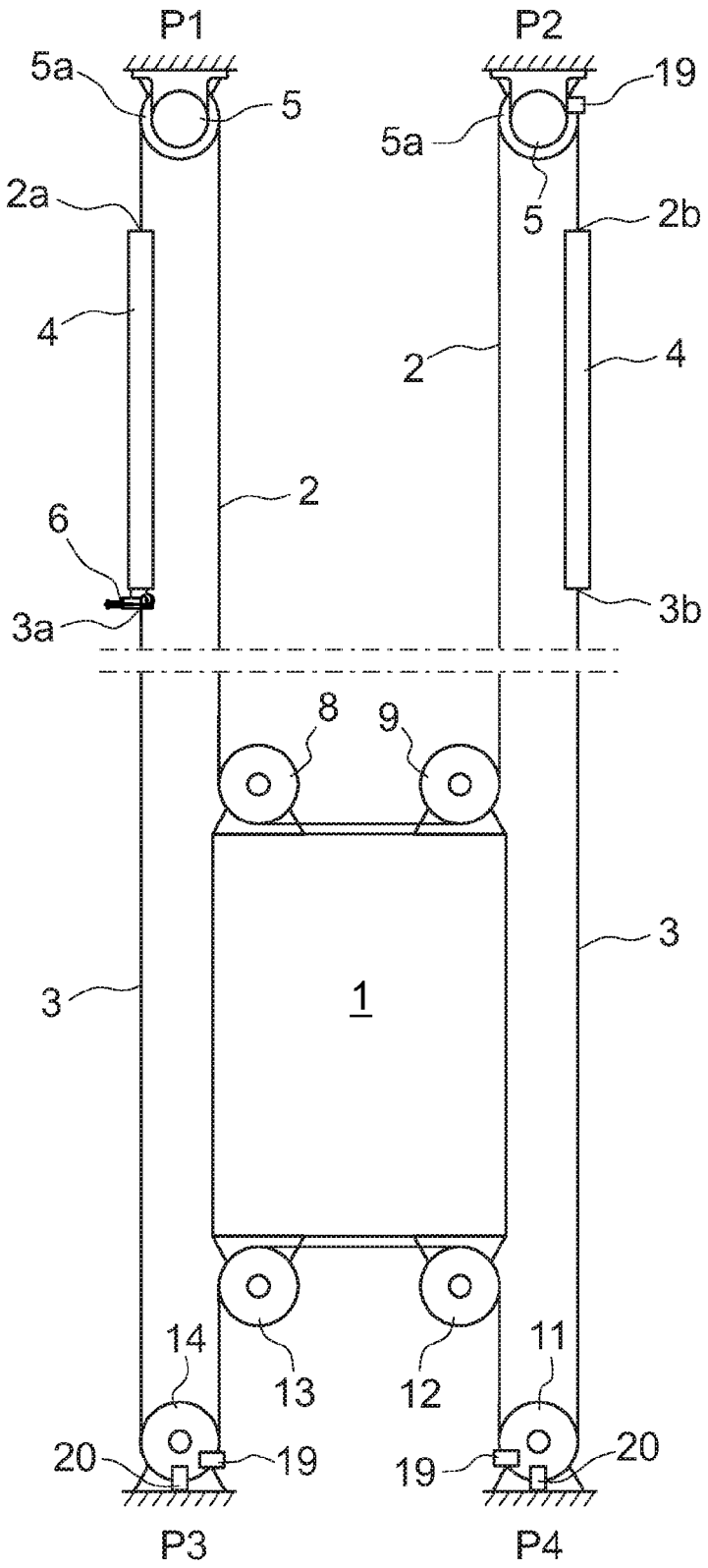

ARRANGEMENT FOR REDUCING DISPLACEMENT OF AN ELEVATOR CAR CAUSED BY A CHANGE IN LOADING

CROSS REFERENCE TO RELATED APPLICATIONS

This application is Continuation of PCT International Application No. PCT/FI2014/050550, filed on Jul. 3, 2014, which claims priority under 35 U.S.C. 119(a) to Patent Application No. 20135737, filed in Finland on Jul. 4, 2013, all of which are hereby expressly incorporated by reference into the present application.

The object of the invention is an arrangement, as defined in the preamble of claim 1, for reducing the displacement of an elevator car caused by a change in loading.

One general elevator solution according to prior art is a traction sheave elevator, in which the elevator machine is in the top part of the elevator hoistway or above the elevator hoistway. The suspension ropes and traction ropes of the elevator car, i.e. the elevator ropes, are conducted around the top of a traction sheave on the elevator machine and the elevator car is fixed to the first end of the elevator ropes and the counterweight to the other end. In this way the elevator ropes are roughly of the same dimension as the height of the elevator hoistway or to some extent longer. When loading this type of elevator car of an elevator according to prior art, the car moves in the vertical direction as a consequence of a change in elongation caused by a change in stress occurring in the elevator ropes.

If an elevator does not have a separate leveling function, a height difference in this case arises between the sill of the elevator car and the sill of the floor level, which height difference poses an accident risk, e.g. the risk of hitting one's foot on the sill increases, in which case there is a large tripping hazard. If, on the other hand, the elevator has a leveling function, the drive system driving the motor of the elevator must start the motor a number of times per one landing stop. This is not economic in terms of energy efficiency.

The elongation problem during loading of elevator solutions known in the art is made worse by the fact that the main floor most used by the elevator is almost always the lowermost, or almost lowermost, floor of the elevator hoistway. When the elevator machine is at the top, the elevator ropes are at their longest exactly when the elevator car is in the bottom end of the elevator hoistway, and in this case also the change in elongation of the elevator ropes caused by loading is at its greatest.

Another significant change in loading affecting the elevator ropes is caused by acceleration/braking. Especially in the acceleration phase of a full load or in an emergency braking situation, the rope tension tries to slacken in a part of the elevator roping.

The aim of the present invention is to eliminate the aforementioned drawbacks and achieve an inexpensive and easy-to-implement arrangement in which the change in elongation of the elevator ropes caused by loading of the elevator car, and the problems and accident risks caused by it, are minimized. Additionally the aim of the invention is to achieve an arrangement, which enables a soft start of the elevator car despite the stress caused by loading. Yet another aim of the invention is to achieve an arrangement, which enables the use of two or more small elevator motors, instead of one large elevator motor, in which case there is the possibility of optimizing energy consumption by using according to the loading only those motors that are needed for exactly that loading. The arrangement according to the invention is characterized by what is disclosed in the characterization part of claim 1. Other embodiments of the invention are characterized by what is presented in the other claims.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can in at least some situations be deemed to be inventive in their own right.

In the invention the displacement of the elevator car caused by a change in loading is reduced by locking at least two rope pulleys corresponding to elevator ropes at least during loading of the elevator car. The elevator ropes comprise at least one rope element above the elevator car and at least one rope element below the elevator car and at least one pretensioning means acting on the elevator ropes. The elevator roping travels via a number of rope pulleys and at least two of the rope pulleys are traction sheaves that the hoisting machine rotates. Preferably of the rope pulleys to be locked to be non-rotating at least one is a traction sheave, even more preferably all the rope pulleys to be locked to be non-rotating are traction sheaves.

Preferably the rope element above the elevator car and the rope element below the elevator car are essentially similar to each other. The rope elements above and below can also differ from each other.

Preferably the rope suspension above the elevator car and the rope suspension below the elevator car are essentially similar to each other. The rope elements above and below can also differ from each other, e.g. in such a way that the suspension ratio of the upper rope suspension is greater or smaller than the suspension ratio of the lower rope suspension Preferably the pretensioning means acting on the elevator ropes brings about pretension in the rope elements, which pretension is always greater than the greatest change caused by loading in a loading situation of the elevator car.

An important manifestation of the invention is that the pretension of the elevator ropes or other rope elements, such as belts, to be used becomes so great that the pretension is always greater than the greatest change in loading in a situation of a change in loading of the elevator car, more particularly in a loading situation. By suitably controlling two elevator motors, each of which rotates its own traction sheave, the rigidity of the elevator roping seen by the elevator car can also be influenced.

One advantage, among others, of the solution according to the invention is that by means of it good controllability of loading and jerk-free starting of the elevator car are enabled. In addition, by using two or more small elevator motors, instead of one large elevator motor, the energy consumption of the elevator can be better optimized, because with small loading torques not all the motors need to be used.

Another advantage is that smaller motors result in a smaller size of the other components, in which case an advantage is obtained in transportation and installation owing to the handling of smaller and lighter units. In addition, an economy of scale is achieved because small motors and their control systems and drive systems are mass-produced, so their prices are cheaper.

Figure 2:
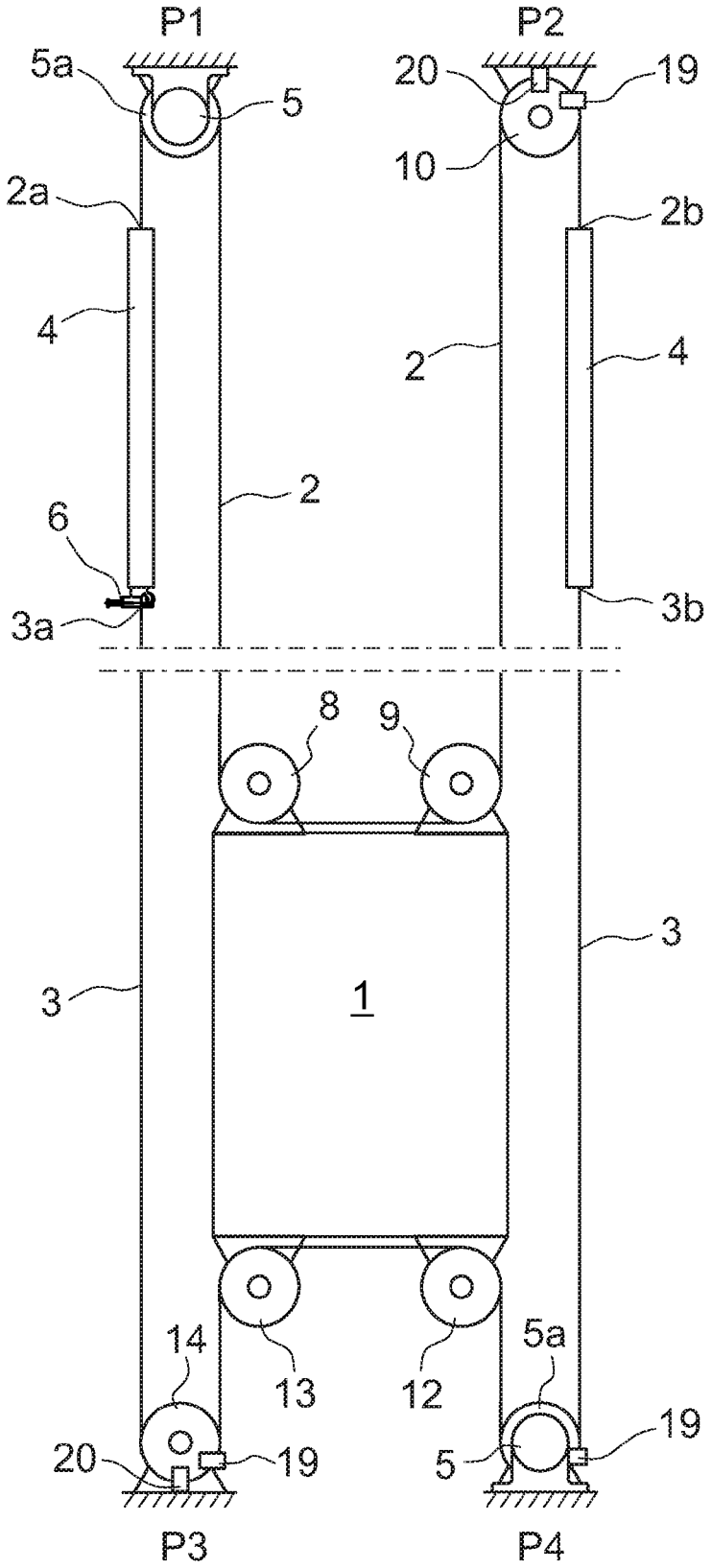
Figure 3:
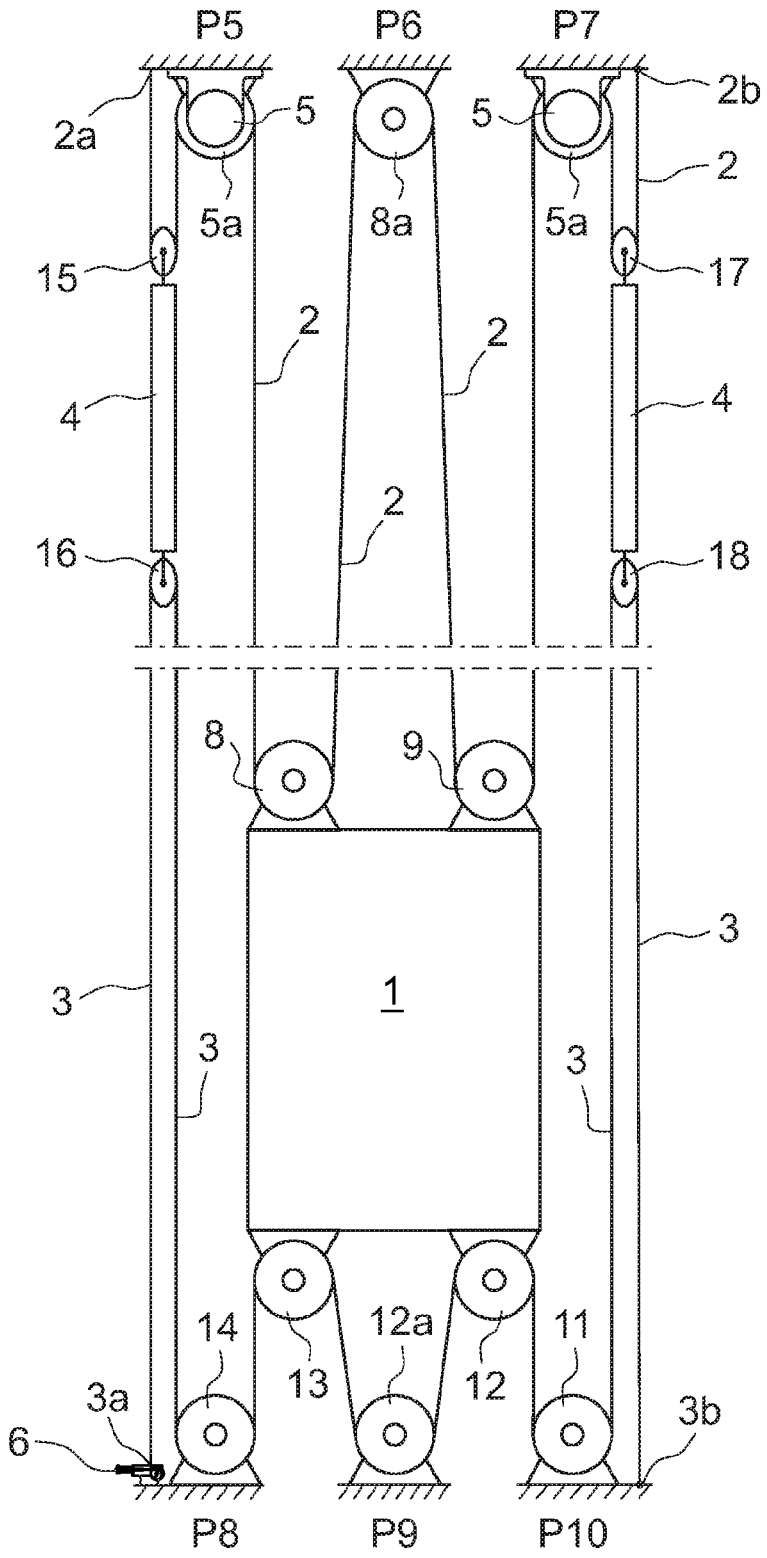
Figure 4:
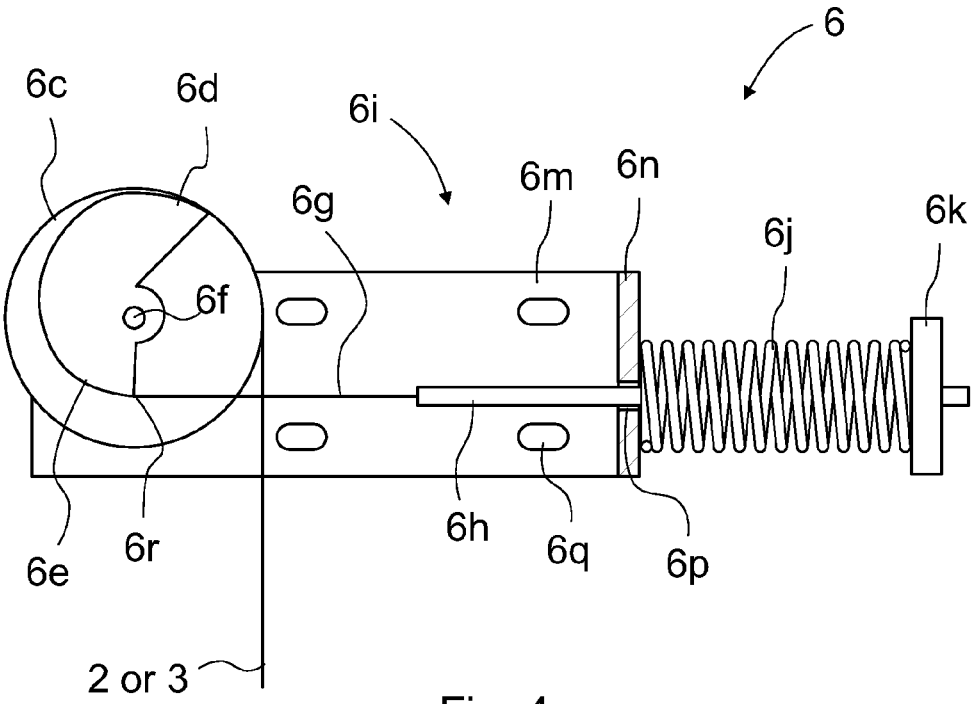
Figure 5:
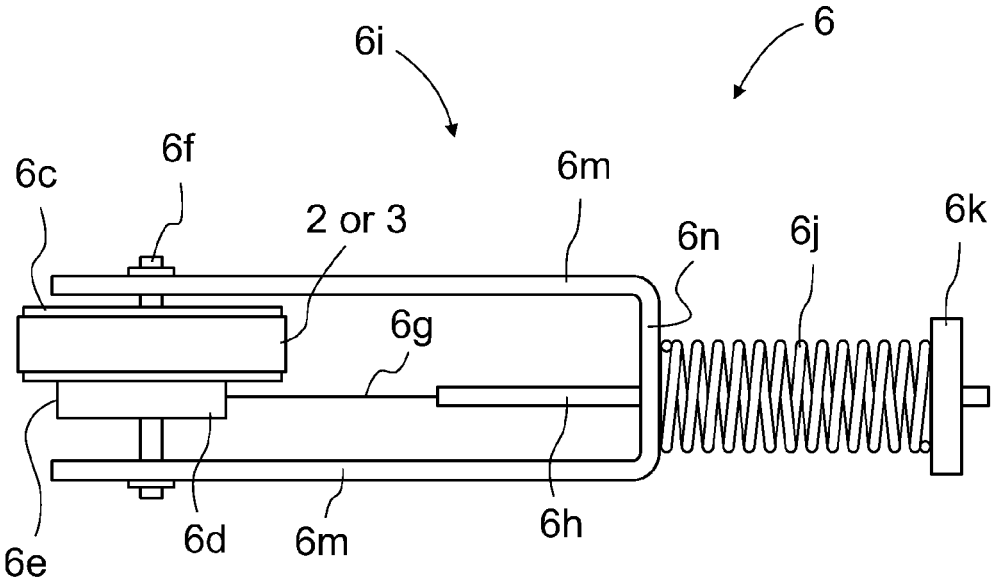

In the following, the invention will be described in more detail by the aid of some examples of its embodiment with reference to the simplified and diagrammatic drawings attached, wherein FIG. 1 presents a simplified and diagrammatic side view of one elevator arrangement according to the invention, with 1:1 suspension, wherein the two hoisting machines of the elevator are disposed in the top part of the elevator hoistway, or close to it, FIG. 2 presents a simplified and diagrammatic side view of another elevator arrangement according to the invention, with 2:1 suspension, wherein the two hoisting machines of the elevator are disposed in the top part of the elevator hoistway, or close to it, FIG. 3 presents a simplified and diagrammatic side view of another elevator arrangement according to the invention, with 2:1 suspension, wherein the one hoisting machine of the elevator is disposed in the top part of the elevator hoistway, or close to it, and the other hoisting machine of the elevator is disposed in the bottom part of the elevator hoistway, or close to it, FIG. 4 presents a simplified and diagrammatic side view of a pretensioning means of a traction member of the elevator to be used in the arrangement according to the invention, and FIG. 5 presents a simplified and diagrammatic top view of the pretensioning means of a traction member of the elevator according to FIG. 4.

The displacement of an elevator car caused by a change in loading, i.e. more precisely of the loading of the elevator car, and the elongation of the elevator ropes supporting the elevator car can be essentially reduced by using one or more, e.g. two, counterweights and by connecting the counterweights to each other at their bottom ends with a rope element, or with a corresponding pliable element, that partly contributes to supporting the load. This type of suspension arrangement, reminiscent of a closed system, is stiffer than a conventional one, and it is exactly this that enables smaller displacement caused by loading.

FIG. 1 presents a simplified and diagrammatic side view of one elevator arrangement according to the invention, said arrangement having 1:1 suspension, wherein there are two hoisting machines 5 of the elevator that are disposed in the top part, or near the top part, of the elevator hoistway. The elevator car 1 and two counterweights 4 functioning as compensating weights are suspended to rest on the first rope element 2 supporting the elevator car 1 and both counterweights 4, and the counterweights 4 are connected to each other at their bottom ends by means of a second rope element 3. In this case one long essentially unbroken loop moving reciprocally while supported by rope pulleys is formed in the elevator suspension, which loop comprises at least a first rope element 2, a second rope element 3 and the two counterweights 4 between them.

In the arrangement according to FIG. 1 the first end 2*a* of the first rope element 2 supporting the elevator car 1 and the counterweights 4 is fixed to the top end of the first counterweight, from where the rope element 2 is led upwards to pass around the top of the traction sheave 5*a* of the first elevator machine 5 fixed to the top part of the elevator hoistway, and after this to descend to the first diverting pulley 8 fixed to the top part of the elevator car 1, after passing around the bottom of which diverting pulley the rope element 2 is led onwards to the second diverting pulley 9 fixed to the top part of the elevator car 1. After it has passed around the bottom of the diverting pulley 9 the rope element 2 is again led upwards to pass around the top of the traction sheave 5*a* of the second elevator machine 5 fixed to the top part of the elevator hoistway, and after this to descend downwards to the second counterweight 4, to the top end of which the second end 2*b* of the rope element 2 is fixed.

Correspondingly, the first end 3*a* of the second rope element 3 is fixed to the bottom end of the first counterweight 4 via a pretensioning means 6 providing a constant tensioning force, from where the rope element 3 is led downwards to pass around the bottom of the first diverting pulley 14 fixed to the bottom part of the elevator hoistway, and after this to ascend to the first diverting pulley 13 fixed to the bottom part of the elevator car 1, after passing around the top of which diverting pulley the rope element 3 is led onwards to the second diverting pulley 12 fixed to the bottom part of the elevator car 1. After it has passed around the top of the diverting pulley 12 the rope element 3 is again led downwards to pass around the bottom of the second diverting pulley 11 fixed to the bottom part of the elevator hoistway, and after this to ascend upwards to the second counterweight 4, to the bottom end of which the second end 3*b* of the rope element 3 is fixed.

Thus a closed loop is formed from the rope elements 2 and 3 as well as from the counterweights 4, the pretensioning of which loop is maintained with a pretensioning means 6 providing a constant tensioning force. The pretensioning of the rope elements thus achieved is dimensioned and configured to be so great that the pretensioning is always greater than the greatest change in loading in a loading situation of the elevator car 1. In practice other effects of changes in the loading states of the elevator ropes are also taken into account, e.g. accelerations and decelerations, the effect of which is at its greatest in the acceleration phase of a full load and in an emergency braking situation. Emergency braking deceleration can be considerably greater than normal acceleration. If undesired slackening of the rope is not permitted in an emergency braking situation, the elongation produced with pretensioning must be greater than the elongation of the loop produced in total by the different parts of the system. Thus the tension of the rope element 3 below the elevator car 1 that is trying to slacken during loading never goes to zero and tension is retained in both rope elements 2 and 3. In this case the other lower rope element 3 of the loop always bears a part of the load prevailing in the suspension system and therefore enables reduction of the rope elongation caused by loading.

In the arrangement are means, in connection with the diverting pulleys 11 and 14 in the bottom part of the elevator hoistway, for locking the vertical movement and rotation of the diverting pulleys 11 and 14 during the loading of the elevator car 1. The means comprise locking means 19 connected to the control system of the elevator for locking the rotational movement of the diverting pulleys 11 and 14 during loading of the elevator car 1, and linear movement prevention means 20 connected to the control system of the elevator for locking the vertical movement of the diverting pulleys 11 and 14 during loading of the elevator car 1. When the elevator car 1 starts to be loaded or its load is discharged, the control system switches the means 19, 20 on to prevent the vertical movement and rotation of the diverting pulleys 11 and 14 during the loading or unloading of the elevator car 1. The locking means 19 could also just as well be disposed in the top part of the elevator hoistway and preferably also at least one traction sheave 5*a* is locked with the locking means 19 to be non-rotating during loading of the elevator car 1.

The arrangement presented by FIG. 2 corresponds to the arrangement presented by FIG. 1 in terms of its suspension, but in FIG. 2 the hoisting machines 5 of the elevator, and their traction sheaves 5*a*, are disposed in a different manner. Now the first hoisting machine 5 is in the top part of the elevator hoistway according to the solution presented by FIG. 1, but the second hoisting machine 5 is in the bottom part of the elevator hoistway. In this case the first rope element 2 passes around the top of the traction sheave 5*a* of the first hoisting machine 5, whereas the second rope element 3 passes around the bottom of the traction sheave 5*a* of the second hoisting machine 5. Additionally, in the solution according to FIG. 2 in the top part of the elevator hoistway there is now a diverting pulley 10 in the location according to FIG. 1 of the second hoisting machine 5.

FIG. 3 presents a simplified and diagrammatic side view of a second elevator arrangement according to the invention, said arrangement having 2:1 suspension, wherein there are two hoisting machines 5 of the elevator that are disposed in the top part, or near the top part, of the elevator hoistway. The elevator car 1 and two counterweights 4 are suspended to rest on the first rope element 2 supporting the elevator car 1 and both counterweights 4, and the counterweights 4 are connected to each other at their bottom ends by means of the second rope element 3.

In the arrangement according to FIG. 3 the first end 2*a* of the first rope element 2 supporting the elevator car 1 and the counterweights 4 is fixed to the top part of the elevator hoistway, or to near it, from where the rope element 2 is led downwards to pass around the bottom of the diverting pulley 15 on the top end of the first counterweight 4, after having passed around which diverting pulley the rope element 2 is led upwards to pass around the top of the traction sheave 5*a* of the first elevator machine 5 fixed to the top part of the elevator hoistway, and after this to descend to the first diverting pulley 8 fixed to the top part of the elevator car 1, after having passed around the bottom of which diverting pulley the rope element 2 is again led upwards to pass around the top of the first diverting pulley 8*a* fixed to the top part of the elevator hoistway, and after this to descend to the second diverting pulley 9 fixed to the top part of the elevator car 1. After it has passed around the bottom of the diverting pulley 9 the rope element 2 is again led upwards to pass around the top of the traction sheave 5*a* of the second elevator machine 5 fixed to the top part of the elevator hoistway, and after this to descend downwards to pass around the bottom of the diverting pulley 17 on the top end of the second counterweight 4, after having passed around which diverting pulley the rope element 2 is again led upwards to the top part of the elevator hoistway, to which the second end 2*b* of the first rope element 2 is fixed.

Correspondingly, the first end 3*a* of the second rope element 3 is fixed to the bottom part of the elevator hoistway via a pretensioning means 6 providing a constant tensioning force, from where the rope element 3 is led upwards to pass around the top of the diverting pulley 16 fixed to the bottom end of the first counterweight 4, from where the rope element 3 is led downwards to pass around the bottom of the first diverting pulley 14 fixed to the bottom part of the elevator hoistway, and after this to ascend to the first diverting pulley 13 fixed to the bottom part of the elevator car 1. After it has passed around the top of the diverting pulley 13 the rope element 3 is again led downwards to pass around the bottom of the second diverting pulley 12*a* fixed to the bottom part of the elevator hoistway, and after it has passed around the bottom of this to ascend to the second diverting pulley 12 fixed to the bottom part of the elevator car 1, after passing around the bottom of which diverting pulley the rope element 3 is led onwards to the third diverting pulley 11 fixed to the bottom part of the elevator car 1. After it has passed around the bottom of the diverting pulley 11 the rope element 3 is led to ascend upwards to the second counterweight 4, after it has passed around the top of the diverting pulley 18 fixed to the bottom end of which counterweight the second rope element 3 is again led downwards to the bottom part of the elevator hoistway, to which the second end 3*b* of the second rope element 3 is fixed.

Thus a closed arrangement is formed from the rope elements 2 and 3 as well as from the counterweights 4, in which arrangement the tautness of the rope elements 2 and 3 is maintained with a pretensioning means 6 providing a constant tensioning force. The second rope element 3 below the arrangement bears a part of the load prevailing in the suspension system and therefore enables reduction of the rope elongation, and thereby displacement of the elevator car 1, caused by loading of the elevator car 1.

In the solution according to FIG. 3 in connection with the traction sheaves 5*a* and diverting pulleys 8*a*, 11, 12 and 14 that are in the top part and bottom part of the elevator hoistway are similar means 19, 20 for locking the vertical movement and rotation of the traction sheaves and diverting pulleys during the loading of the elevator car 1 as in the solutions presented in FIGS. 1 and 2, but for the sake of clarity they are not presented in FIG. 3.

All the embodiments present two hoisting machines 5 with traction sheaves 5*a*. There can, however, be more than two hoisting machines 5 within the scope of the inventive concept. A hoisting machine 5 and its traction sheave 5*a* can be disposed anywhere in the top part of the elevator hoistway whatsoever instead of the diverting pulley 8*a*, 10 presented and/or anywhere in the bottom part of the elevator hoistway whatsoever instead of the diverting pulley 11, 12*a*, 14 presented. Thus in the arrangement according to FIG. 1 a hoisting machine 5 with its traction sheave 5*a* can be e.g. in the positions P1 and P2, as presented in FIG. 1; in positions P1 and P4, as is presented in FIG. 2; in positions P2 and P3; or in positions P3 and P4.

Correspondingly, in the arrangement of FIG. 3, the hoisting machine 5 with its traction sheave 5*a* can alternatively be e.g. in the positions P5 and P7, P8 and P10, P5 and P10, P7 and P8. The pulleys in positions P6 and P9 are compensating pulleys, with which speed differences of the driving pulleys are compensated. In this way the hoisting machines can be driven in a manner that is to some extent asynchronous. In an ideal situation, in which the hoisting machines are made to drive the hoisting rope fully synchronously, the pulleys of the positions P6 and P9 would be non-rotating.

In practice, therefore, only certain paired positions of the hoisting machine 5 are advantageous from the viewpoint of proper functioning of the arrangement, although in principle the hoisting machines 5 could be disposed in more positions than are presented above, especially if the synchronization of their running is flawless.

The arrangement also comprises means for synchronizing the drive motors and electric drives of the hoisting machines 5 in such a way that all the traction sheaves 5*a* rotate as simultaneously as possible with each other, at the same speed and in the same direction, as well as refrain from rotating as simultaneously as possible. There can be two hoisting machines 5 or even more, e.g. 3, 4, 5, 6 or even more, but if there are more than two hoisting machines 5, synchronization of the hoisting machines 5 with each other is in practice extremely awkward.

The pretensioning means 6, of which there must be at least one for maintaining the tautness needed by the rope elements 2 and 3, can be at one or more ends 2*a*, 2*b*, 3*a*, 3*b* of a rope element 2, 3. However, it is advantageous to dispose the pretensioning means 6 essentially on the second rope element 3 below the elevator car 1, in which case a smaller rope tension acts on the pretensioning means 6 than in the rope element 2 above the elevator car 1.

In addition, the pliable rope elements 2 and 3 can be similar or different to each other. They can be belt-type elements or elements provided with transverse or oblique teeth, e.g. toothed belts, or they can also be a plurality of parallel ropes. In the arrangement according to the invention both the rope elements 2 and 3 of the elevator car 1 can function, together or separately, as a traction member moving the elevator car 1. In the solutions according to FIGS. 1 and 2 the first rope element 2 above the elevator car 1 functions as a traction member and at the same time as a suspension member, whereas the second rope element 3 below the elevator car 1 functions as an element that compensates tension and partly supports the load. In this case at least two hoisting machines 5 of the elevator, with their traction sheaves 5*a*, are in the top part of the elevator hoistway or near it.

Correspondingly, in the solution according to FIG. 3 the first rope element 2 above the elevator car 1 functions as a traction member and at the same time as a suspension member supporting the load, whereas the second rope element 3 below the elevator car 1 also functions as a traction member and at the same time as an element that compensates tension and partly supports the load. In this case at least one elevator hoisting machine 5 with its traction sheave 5*a* is in the top part of the elevator hoistway, or near it, and at least one elevator hoisting machine 5 with its traction sheave 5*a* is in the bottom part of the elevator hoistway, or near it.

In addition, the concept according to the invention also includes a solution in which the first rope element 2 above the elevator car 1 functions mainly only as a suspension member supporting the load of the elevator car 1, whereas the second rope element 3 below the elevator car 1 functions as a traction member and at the same time as an element that compensates tension and partly supports the load. In this case, correspondingly, at least two drive machines 5 of the elevator, with their traction sheaves 5*a*, are in the bottom part of the elevator hoistway or near it.

In the solutions according to FIGS. 1 and 3 two hoisting machines 5 move by means of their own traction sheaves 5*a* one and the same rope element 2 above the elevator car 1, said rope element functioning as a traction member. In a corresponding situation in which there are hoisting machines 5 only in the bottom end of the elevator hoistway, two hoisting machines 5 move by means of their own traction sheaves 5*a* one and the same rope element 3 below the elevator car 1, said rope element functioning as a traction member. If there are three or more hoisting machines 5 and they are only either in the top end or bottom end of the elevator hoistway, then at least three hoisting machines move one and the same rope element 2 or 3.

In the solution according to FIG. 2 one hoisting machine 5 moves by means of its own traction sheave 5*a* one rope element 2 above the elevator car 1, said rope element functioning as a traction member, and the second hoisting machine 5 moves by means of its own traction sheave 5*a* one rope element 3 below the elevator car 1, said rope element functioning as a traction member. If there are two hoisting machines 5 at both ends of the elevator hoistway, then at least two hoisting machines 5 move by means of their own traction sheaves 5*a* one and the same rope element 2 above the elevator car 1, said rope element functioning as a traction member, and at least two hoisting machines 5 move by means of their own traction sheaves 5*a* one and the same rope element 3 below the elevator car 1, said rope element functioning as a traction member.

It is advantageous for the solution according to the invention that the rope elements 2 above the elevator car 1 and the rope elements 3 below the elevator car 1 are essentially similar to each other. In this case the largest displacement caused by the loading of the elevator car 1 is at the midpoint of the elevator hoistway and the smallest is at the ends of the elevator hoistway. The smallest displacement at the ends is so small that releveling is not even needed for compensating it.

It is advantageous to implement the arrangement according to the invention in such a way that in the arrangement there are the aforementioned means 19, 20 for locking the vertical movement and rotation of the diverting pulleys 8*a*, 10, 11, 12, 12*a* and 14 in the top part and bottom part of the elevator hoistway during the loading of the elevator car 1. During loading the discharge of tension produced in the roping, i.e. in the rope elements 2 and 3, in connection with the starting of the elevator car 1 is received in a controlled manner by the motor drive of the hoisting machine 5 and by the mechanical brake. In this case the elevator car 1 is made to start moving softly without nudging caused by the sudden discharge of the tension. It is advantageous to dispose a number of small motor drives and hoisting machines 5 provided with a mechanical brake in the locations of the diverting pulleys 8*a*, 10, 11, 12, 12*a* and 14 in the top part and bottom part of the elevator hoistway, in which case displacement of the elevator car can be made to be extremely small and likewise the hoisting machines 5 can be small in both size and output power.

One part of the rope pulleys 5*a*, 8, 8*a*, 9-12, 12*a*, 13, 14, 15-18 of the suspension function as traction sheaves 5*a*, the second part as diverting pulleys 8*a*, 10, 11, 12*a* and 14 disposed in the elevator hoistway, and the third part as diverting pulleys 8, 9, 12 and 13 moving along with the elevator car 1 and also the fourth part as diverting pulleys 15-18 moving along with the counterweights.

FIGS. 4 and 5 present one pretensioning means 6 of a rope element 2, 3 of an elevator, which pretensioning means is suited for use in an arrangement according to the invention and which is configured to enable tensioning that is of as constant a force as possible in the rope elements 2, 3.

The pretensioning means 6 comprises at least a frame part 6*i*, a roll 6*c* mounted on bearings onto an axle 6*f* so as to rotate freely, an adjustment means 6*d* rotating along with the roll 6*c*, and also a tensioning means 6*g*, the free end of which is tensioned by the aid of a spring 6*j* into its position in the second end of the frame part 6*i*. The frame part 6*i* is e.g. a metal plate bent into a U-shape, as viewed from above, comprising a base part 6*n* and two side flanges 6*m* that are in an orthogonal attitude with respect to it, in at least one of which side flanges are fixing holes 6*q* for fixing the pretensioning means 6 to its mounting base. Correspondingly, the base part 6*n* at the second end of the frame part 6*i* has a hole 6*p* for the rod 6*h* at the free end of the tensioning means 6*g*, through which hole 6*p* the rod 6*h* can be threaded. In addition, there is a hole in the first end, i.e. the free end, of the side flanges 6*m* for the axle 6*f* of the roll 6*c*.

The end of the rope element 2, 3 of the elevator is fixed to the outer rim of the roll 6*c* in such a way that the end of the rope element 2, 3 can be coiled for some distance onto the roll 6*c* when the roll 6*c* rotates around its axle 6*f* as the rope element 2, 3 loosens.

An adjustment means 6*d* rotating along with the roll 6*c*, and having an essentially e.g. spiral outer surface 6*e* that is eccentric with respect to the axis of rotation 6*f*, is fixed to the side of the roll in connection with the roll 6*c*, the length of which eccentric outer surface 6*e* in the arrangement according to the embodiment comprises less than one revolution, i.e. the length of the spiral outer surface 6*e* is smaller than 360°. A tensioning means 6*g*, such as a steel rope or plastic rope or corresponding, is fitted for rotating the eccentric outer surface 6*e* of the adjustment means 6*d*, which tensioning means is fixed at its first end to move along with the roll 6*c* and the adjustment means 6*d*, and at its second end to a tensioning arrangement provided with a rod 6*h* through the base part 6*n* of the frame part 6*i*, with a flange 6*k* and also with a compression spring 6*j*, in which tensioning arrangement the compression spring 6*j* is arranged to press against the outer surface of the base part 6*n* of the frame part 6*i* in such a way that the tensioning arrangement pulls the tensioning means 6*g* by the aid of the spring force of the spring 6*j* and keeps the tensioning means 6*g* always as taut as possible by the aid of its spring force.

The eccentricity, i.e. the spiral pitch, of the outer rim 6*e* of the adjustment means 6*d* is selected in such a way that it corresponds to the spring constant of the spring 6*j*, in which case in all the rotational positions of the adjustment means 6*d* the tensioning of the rope elements 2, 3 remains essentially the same corresponding to the spring constant. When the rope elements 2, 3 stretch or otherwise loosen from the effect of the loading, the spring 6*j* pulls the tensioning means 6*g* and via it rotates the roll 6*c* and the adjustment means 6*d* in such a way that the distance of the outer rim 6*e* of the adjustment means 6*d* from the axle 6*f* at the point of detachment 6*r* of the tensioning means 6*g* increases according to the eccentricity of the outer rim 6*e*. The eccentricity, i.e. the spiral pitch, of the outer rim 6*e* of the adjustment means 6*d* can also be selected in such a way that the adjustment means 6*d* can compensate in the aforementioned manner a spring other than a compression spring 6*j*, e.g. a gas spring, a draw-spring or some other means providing a spring force.

One preferred solution included in the idea according to the invention is connecting two hoisting machines 5 to the arrangement in such a way that the travel distance of the elevator car 1 is always between two hoisting machines 5. In addition, the use of two hoisting machines 5 has the advantage that when one of the hoisting machines 5 stops for some reason, it is however still possible to drive with the other hoisting machine 5. In this case, e.g. in the solution according to FIG. 1, in which both hoisting machines 5 are in use, the elevator operates with a 1:1 suspension ratio. If for some reason in this type of situation one of the hoisting machines 5 stops or is stopped, and there is no slipping in the rope element 2 on the traction sheaves 5*a*, the elevator can still be driven with one hoisting machine 5, but in this case the section of the rope element between the traction sheaves 5*a*, on which section the elevator car is suspended, functions with a suspension ratio that becomes 2:1, in which case therefore the suspension ratio of the elevator car 1 is 2:1. Correspondingly, the suspension ratio of the counterweights 4 on the section between the traction sheaves 5*a* and the diverting pulleys 11, 14, which diverting pulleys are in the bottom part of the elevator hoistway, remains as 1:1. The fact that in this type of situation the suspension ratio changes is not a problem from the viewpoint of the operation of the arrangement, because in this case only the speed of the elevator car 1 halves, which deteriorates the service but which, however, enables a service e.g. in a machine breakdown situation.

Another preferred solution included in the idea according to invention is connecting two hoisting machines 5 to the arrangement in such a way that when both hoisting machines 5 are in operation an asynchronous run with them is possible. For example, in the solutions according to FIGS. 1 and 2 a run in which the hoisting machines 5 are asynchronous with each other for at least a part of the travel distance is possible when a sufficiently good flexing arrangement has been fitted to the suspension system as well as an end monitoring arrangement at the top end and bottom end of the elevator hoistway. End monitoring is required so that consecutive asynchronous runs would not be able to act in such a way that although the elevator car 1 was not yet in its extreme position in one end of the elevator hoistway, at least one counterweight would be already have arrived at its extreme position in the opposite end of the elevator hoistway and would continue past it without end monitoring. A part of the aforementioned asynchronous run movement of the elevator car 1 can be e.g. a rescue run.

It should also be noted that the different solutions and features presented above can be inventive features together with one or more other features of the invention.

It is obvious to the person skilled in the art that the invention is not limited solely to the examples described above, but that it may be varied within the scope of the claims presented below. Thus, for example, the suspension solutions can be different to what is presented above.

It is also obvious to the person skilled in the art that the locations of the hoisting machines can be elsewhere than what is presented above in the drawings. The hoisting machine can be on the base of the elevator hoistway, or near the base, on the roof of the elevator hoistway, or near it, in a separate machine room, but also on some side of the elevator hoistway.

It is also obvious to the person skilled in the art that the number of counterweights can also be greater than two. There can be e.g. four, six, eight, ten or even more small-sized compensating weights disposed in a different manner, and they can be disposed side-by-side and/or on different sides of the elevator car.

It is also obvious to the skilled person that there can be e.g. two parallel ropings, instead of one, comprised of rope elements, in which case the number of hoisting machines can also be doubled, but in this case the size of the hoisting machines can be extremely small compared to the one and only hoisting machine according to prior art.

It is further obvious to the person skilled in the art that the pretensioning means providing constant tensioning force to the rope elements can just as well be different to what is presented above.

The invention claimed is:

1. An arrangement for reducing the displacement of an elevator car caused by a change in loading, comprising:

the elevator car configured to move up and down in an elevator hoistway;

one or more counterweights;

at least one rope element essentially above the elevator car;

at least one rope element essentially below the elevator car; and at least one pretensioner of the rope elements, wherein the elevator car and one or more counterweights are configured to be supported and to be moved via the rope elements and the at least one pretensioner, and a plurality of rope pulleys, of which rope pulleys the first part are diverting pulleys, and the second part are traction sheaves or corresponding, wherein the arrangement comprises at least two hoisting machines, wherein the arrangement includes a locking mechanism configured to lock at least two rope pulleys to be non-rotating at least during loading of the elevator car, wherein a first end of the at least one rope element below the elevator car is fixed to, via the pretensioner, a bottom end of one of the one or more counterweights or a bottom part of the elevator hoistway, a second end of the at least one rope element below the elevator car is led to pass around one or more of the plurality of rope pulleys, and the pretensioner is configured to provide a constant tensioning force to the at least one rope element below the elevator car, and wherein the pretensioner includes:

a roll rotating around an axis of rotation;

an adjustment element fixed to the roll, the adjustment element rotating along with the roll and being eccentric with respect to the axis of rotation of the roll; and a tensioning rope is configured to rotate the adjustment element under a tensioning force, wherein the at least one rope element below the elevator car is fixed to an outer rim of the roll such that the first end of the at least one rope element below the elevator car can be coiled onto the roll when the roll rotates around the axis of rotation as the at least one rope element loosens.

2. The arrangement according to claim 1, wherein of the rope pulleys to be locked to be non-rotating during loading of the elevator car, at least one is a traction sheave.

3. The arrangement according to claim 2, wherein in the arrangement is a mechanism configured to lock the vertical movement and rotation of the diverting pulleys in the top part and bottom part of the elevator hoistway during the loading of the elevator car.

4. The arrangement according to claim 2, wherein the rope element above the elevator car and the rope element below the elevator car are essentially similar to each other.

5. The arrangement according to claim 2, wherein the pretensioner is arranged to bring about pretension in the rope elements, said pretension being preset to be greater than a pre-estimated greatest change caused by the loading in a loading situation of the elevator car.

6. The arrangement according to claim 2, wherein, for discharging in a controlled manner, in connection with starting of the elevator car, the tension produced in the roping during loading of the elevator car, the hoisting machines comprise a mechanical brake and a motor drive.

7. The arrangement according to claim 1, wherein in the arrangement is a mechanism configured to lock the vertical movement and rotation of the diverting pulleys in the top part and bottom part of the elevator hoistway during the loading of the elevator car.

8. The arrangement according to claim 7, wherein the rope element above the elevator car and the rope element below the elevator car are essentially similar to each other.

9. The arrangement according to claim 7, wherein the pretensioner is arranged to bring about pretension in the rope elements, said pretension being preset to be greater than a pre-estimated greatest change caused by the loading in a loading situation of the elevator car.

10. The arrangement according to claim 7, wherein, for discharging in a controlled manner, in connection with starting of the elevator car, the tension produced in the roping during loading of the elevator car, the hoisting machines comprise a mechanical brake and a motor drive.

11. The arrangement according to claim 1, wherein the rope element above the elevator car and the rope element below the elevator car are essentially similar to each other.

12. The arrangement according to claim 11, wherein the pretensioner is arranged to bring about pretension in the rope elements, said pretension being preset to be greater than a pre-estimated greatest change caused by the loading in a loading situation of the elevator car.

13. The arrangement according to claim 1, wherein the pretensioner is arranged to bring about pretension in the rope elements, said pretension being preset to be greater than a pre-estimated greatest change caused by the loading in a loading situation of the elevator car.

14. The arrangement according to claim 1, wherein, for discharging in a controlled manner, in connection with starting of the elevator car, the tension produced in the roping during loading of the elevator car, the hoisting machines comprise a mechanical brake and a motor drive.

15. The arrangement according to claim 1, wherein the two hoisting machines are configured to move one and the same rope element.

16. The arrangement according to claim 1, wherein the two hoisting machines are configured to move one and the same rope element that is above the elevator car.

17. The arrangement according to claim 1, wherein the two hoisting machines are configured to move one and the same rope element that is below the elevator car.

18. The arrangement according to claim 1, wherein the two hoisting machines include a first hoisting machine configured to move the rope element that is above the elevator car and a second hoisting machine configured to move the rope element that is below the elevator car.

19. The arrangement according to claim 1, wherein the elevator is provided with four hoisting machines, of which two hoisting machines are configured to move the rope element that is above the elevator car and two hoisting machines are configured to move the rope element that is below the elevator car.

20. The arrangement according to claim 1, wherein the elevator is provided with six hoisting machines, of which three hoisting machines are configured to move the rope element that is above the elevator car and three hoisting machines are configured to move the rope element that is below the elevator car.

* * * * *